US005655708A

United States Patent [19]

Gröne

[11] Patent Number: 5,655,708

[45] Date of Patent: Aug. 12, 1997

[54] FOOD TRAY AND PROCESS FOR MANUFACTURE

[76] Inventor: Horst-Ditmar Gröne, Klint 2a, 28790 Schwanewede/Neuenkirchen, Germany

[21] Appl. No.: 332,242

[22] Filed: Oct. 31, 1994

[30] Foreign Application Priority Data

| | | | |
|---|---|---|---|
| Jun. 19, 1992 | [DE] | Germany | 42 20 195.0 |
| Mar. 1, 1993 | [DE] | Germany | 43 06 288.1 |
| Apr. 23, 1993 | [DE] | Germany | 43 13 334.7 |

[51] Int. Cl.[6] ..... B65D 1/34

[52] U.S. Cl. ..... 229/407; 426/426

[58] Field of Search ..... 229/407; 220/623; 206/557, 204; 426/129

[56] References Cited

U.S. PATENT DOCUMENTS

| | | | |
|---|---|---|---|
| Re. 33,143 | 1/1990 | Gröne . | |
| 3,040,947 | 6/1962 | Roger et al. . | |
| 3,040,948 | 6/1962 | Wells . | |
| 3,067,921 | 12/1962 | Reifers . | |
| 3,156,402 | 11/1964 | Dupuis . | |
| 3,288,346 | 11/1966 | Peppler . | |
| 3,346,400 | 10/1967 | Roesner . | |
| 3,396,430 | 8/1968 | Westcott . | |
| 3,450,326 | 6/1969 | Foote | 229/407 |
| 3,756,681 | 9/1973 | Croston | 426/129 X |
| 3,974,722 | 8/1976 | Florian . | |
| 4,533,585 | 8/1985 | Holden . | |
| 4,576,278 | 3/1986 | Laiewski et al. | 229/407 X |
| 4,949,897 | 8/1990 | Pawlak et al. . | |

FOREIGN PATENT DOCUMENTS

| | | |
|---|---|---|
| 0 182 139 | 5/1986 | European Pat. Off. . |
| 1168425 | 10/1969 | United Kingdom . |

*Primary Examiner*—Allan N. Shoap
*Assistant Examiner*—Christopher J McDonald
*Attorney, Agent, or Firm*—Varnum, Riddering, Schmidt & Howlett LLp

[57] ABSTRACT

A tray for containing fluid-exuding foods, such as meat, fish and the like, comprises a laminate having upper and lower laminae, with openings in the upper lamina. Fluid retaining cavities are formed in the lower lamina or between adjacent lamina to keep exuded liquids away from the food and out of sight of the purchaser. The upper surface of the lower lamina is embossed to form regularly shaped liquid containment cells. The openings in the upper layer are preferable aligned in accordance with a predefined pattern and in register with the cells on the lower lamina. An intermediate lamina of absorbent material and a reticulate lamina may be disposed between the upper and lower lamina.

6 Claims, 16 Drawing Sheets

FOOD TRAY AND PROCESS FOR MANUFACTURE

This is a continuation-in-part of International Application No. PCT/GB93/01298, International Filing Date Jun. 18, 1993.

BACKGROUND OF THE INVENTION

1. Field of the Invention

The invention concerns a tray for the containment of liquid-exuding foods, such as meat, fish or poultry, and a process for manufacturing the tray.

2. Background Art

In packaging for liquid-exuding foods, for instance meat, poultry, fish or the like, movement of the fluid is to be avoided. Meat juices flowing back and forth look unappetizing and can lead to soiling through drainage during unpacking or when the package is damaged. It is known to absorb liquid in food trays by manufacturing the trays from absorbent material or by providing an absorbent insert. The One prior art food tray has two laminae of watertight synthetic material with an absorbent insert in between. The inner lamina shell or upper lamina facing the food item has openings that facilitate the passage of the liquid to the absorbent lamina. The effectiveness of the absorbent lamina depends to a significant extent on the size of the openings. Further a three-laminae food tray as well as a process for manufacturing the tray are known. An absorptive material, particularly paper, is arranged between an upper and a lower lamina of synthetic foam material and at least the lamina that is oriented toward the packaged item is provided with fully penetrating openings. Through these openings, liquids exuding from the foods can flow to the absorptive middle lamina.

A fundamental disadvantage of the known trays is the difficulty of manufacture. Furthermore, the three-laminae tray consists of two different materials, namely, synthetic foam and paper and the waste accumulated during the production of the trays is not recyclable or is recyclable only at a disproportionately high expenditure.

In one known manufacturing process, a two-laminae packaging tray, consisting exclusively of synthetic foam, is known in which cavities are formed in the lower lamina by a deep drawing process. A disadvantage of this prior art arrangement is that the formation of the cavities requires its own deep drawing process.

Since food trays are typically a disposable item, costs of the item must be held to a minimum and efficient and cost-effective production techniques are sought. Of foremost importance in food trays is the liquid retaining capacity. Significant improvements have been made in the liquid retaining capacity by increasing the volume of space between adjacent lamina forming the tray. Food trays may be produced efficiently by forming an upper lamina and a lower lamina and joining the two laminae. The joined laminae are then deformed together by deep drawing at an elevated temperature. One problem with that procedure is that the liquid retaining space of the tray tends to be reduced in the deforming process, thereby reducing the liquid retaining capacity of the product.

SUMMARY OF THE INVENTION

In accordance with one aspect of the present invention, the upper lamina of a double bottom food tray is provided with openings that widen in at least a lower segment of their depth toward the lower lamina and are provided with an upper circumferential edge. Due to a capillary effect in the region of the openings, an enhanced liquid reservoir is created. The upper circumferential edge formed by the transition from an opening surface to the top surface of the upper lamina is preferably formed as sharply and precisely as the manufacturing process permits to enhance the capillary effect. In accordance with this invention, the capillary effect is further enhanced by the widening of the openings in at least a lower segment of their depth.. The widened openings in the lower segment, adjacent the lower lamina, form liquid retaining cavities in combination with the lower lamina, in which the liquid is held by the capillary effect.

Furthermore, the openings in the upper lamina may be provided with a lower rim with a circumferential radius such that the diameter of the openings adjacent the lower lamina is increased even further, thereby increasing the capillary effect in this area.

It is especially advantageous when the openings in the upper lamina are equipped with a cylindrical depression adjacent the lower rim. An additional circumferential crevice is formed by this depression for the storage of additional liquid between the opening surfaces and the lower lamina.

Preferably, a ring-shaped area is provided between the upper lamina and the lower lamina around at least a portion of each opening where there is no solid connection between the two laminae. An additional capillary effect is formed in this ring-shaped area. In areas where the laminae are touching but not bonded, cavities in which liquid can collect are formed due to unevenness and material tolerances.

The liquid retention capacity of the tray is increased even further, without enlarging the openings which contact the packaged food, by providing an enlarged diameter cylindrical section in a lower portion of the openings.

A tray in accordance with this invention does not require an additional absorbent insert since the tray itself retains the liquid. An additional absorbent lamina may be provided, however, and the effectiveness of the absorbent lamina is improved in trays in accordance with the present invention.

The food tray having an upper and a lower lamina and capillary openings in the upper lamina in accordance with the invention may be manufactured in a simple fashion, particularly when a foamed synthetic material, such as polystyrene, is used. The tray is preferably manufactured by punching openings in the upper lamina, from the bottom surface of the upper lamina, to form a rim with a defined radius in the region of the bottom surface and an edge in the region of the top surface, and subsequently joining the bottom of the upper lamina to the top of the lower lamina.

Further in accordance with this invention liquid retaining cavities are formed in the lower lamina by compressing the synthetic foam material to maximum compression such that the structure of the synthetic foam is destroyed and the air chambers that are enclosed within the synthetic foam are eliminated. Advantageously, the cavities of the material strip can be easily produced without the need for a deep drawing process that is required in the prior art.

A particularly advantageous form of the cavities is achieved by compressing the material strip to varying degrees providing maximum compression in certain areas and partial compression in other areas. In this manner, the structure of the synthetic foam will remain intact in some areas leaving air chambers embedded in the synthetic foam in certain areas. During the deformation this partial compression is partially reversed for the formation of crests on the floor of the cavities.

In addition to forming cavities in the lower lamina, cavities may also be formed in the upper lamina of the tray to provide a tray having an even larger capacity for storing liquids exuded from the packaged food.

In accordance with this invention, the cavities are formed by compressing a strip of the material in such a manner that the dimensions of the strip, especially its thickness, are retained. This results in packages that are particularly space-saving, for instance in storage on a refrigerator shelf. The cavities are formed inexpensively by embossing. Advantageously, the thickness of the material strip is not increased by embossing.

In one version of the tray, the cavities have different depths. The cavities may be formed to extend in any desired direction. The cavities satisfy individual requirements and are easily and inexpensively manufactured. A fundamental advantage of these cavities is that in an inclined position of the tray only a portion of the liquids received by the cavities is able to run off to one side of the tray. This prevents the liquids from flowing back through the openings in the upper lamina into the interior of the tray.

In accordance with one aspect of the invention, the upper lamina of the laminate is formed with a plurality of apertures intersecting the upper end lower surfaces of the upper lamina and adapted to receive liquid. The cross-sectional area of each of the apertures is preferably greater at the lower surface of the lower lamina than at the upper surface thereof. The apertures may be formed in the upper lamina in at least two different sizes and in predetermined patterns.

In accordance with another aspect of the invention, a reticulate lamina is disposed adjacent the upper surface of the lower lamina. A lamina of absorbent material may be disposed between the upper lamina and the lower lamina and the absorbent lamina and reticulate lamina may be treated with a wetting agent to improve the conduction of liquid away from the upper lamina.

The lower lamina is formed with a plurality of pockets in the upper surface thereof and each of at least certain of the apertures in the upper lamina communicate with at least one of the pockets in the lower lamina. The pockets in the lower lamina are preferably defined by a series of walls formed in the upper surface of the lower lamina.

In accordance with one aspect of the invention, food trays formed from laminae provided with voids for retaining liquid are formed by method and apparatus which applies compression forces in specific regions, or high pressure points, in one of the laminae. Advantageously, applying higher pressure in specific regions has the effect of reducing overall pressure being applied to the laminae, thereby allowing the desired voids to be retained in other areas of the laminae without substantial reduction in liquid retaining capacity in the other areas. In one specific embodiment of the invention, the trays are formed by positioning the joined laminae between a male die and a female die and wherein one of the dies is provided with protrusions projecting outwardly from the surface of the one die in the direction of the other die. The laminae are preferably heated before the deforming process. Advantageously, the one of the laminae adjacent the die without the protrusions will tend to cool more quickly than the lamina adjacent the die with the protrusions. Consequently, deformations due to the protrusions will occur primarily in the one lamina adjacent the die provided with the protrusions. Furthermore, vacuum may be advantageously applied in the area of the protrusions to draw the more pliable lamina onto the protrusions to form larger cavities in the that lamina in the regions adjacent the pressure points created by protrusions.

BRIEF DESCRIPTION OF THE DRAWINGS

Exemplary embodiments of the invention are described below with reference to the drawings, in which.

Figure 12:
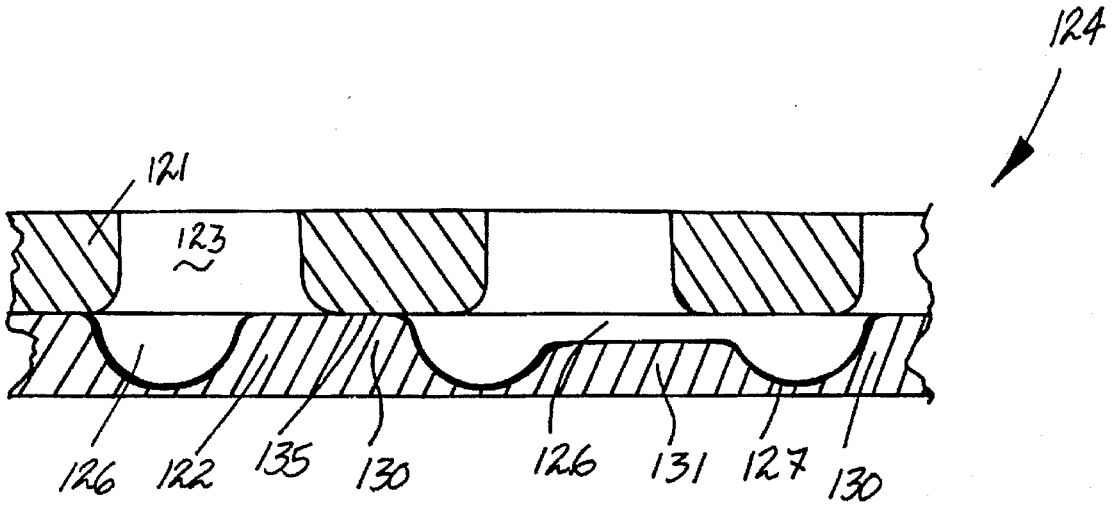
FIG. 12 is an enlarged partial cross section of the tray according to the section 12—12 in FIG. 10.
Figure 13:
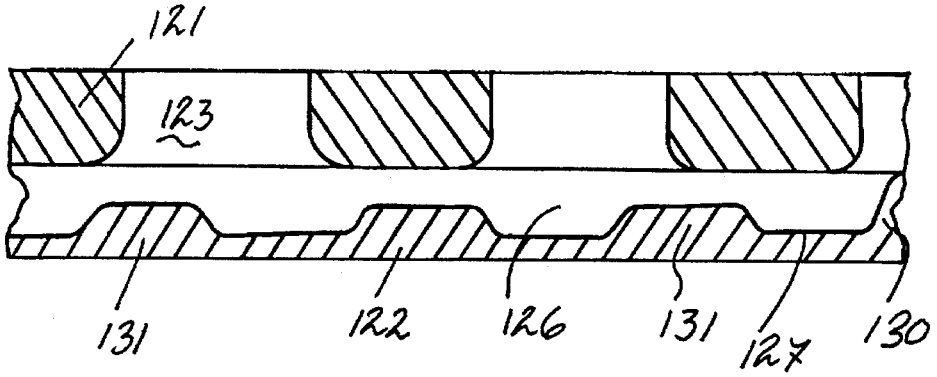
FIG. 13 is an enlarged partial cross section of the tray according to the section 13—13 in FIG. 10.
Figure 17:
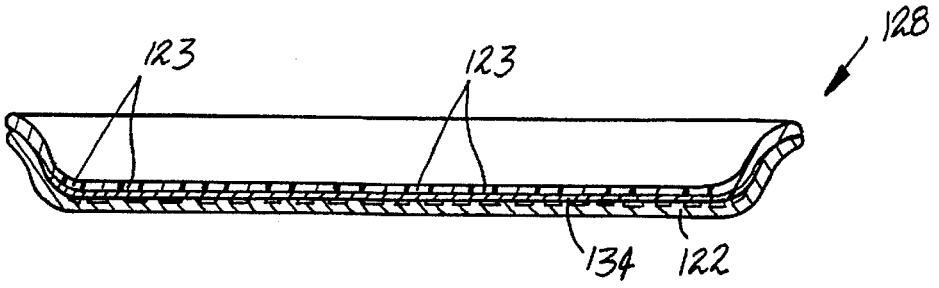
Figure 18:
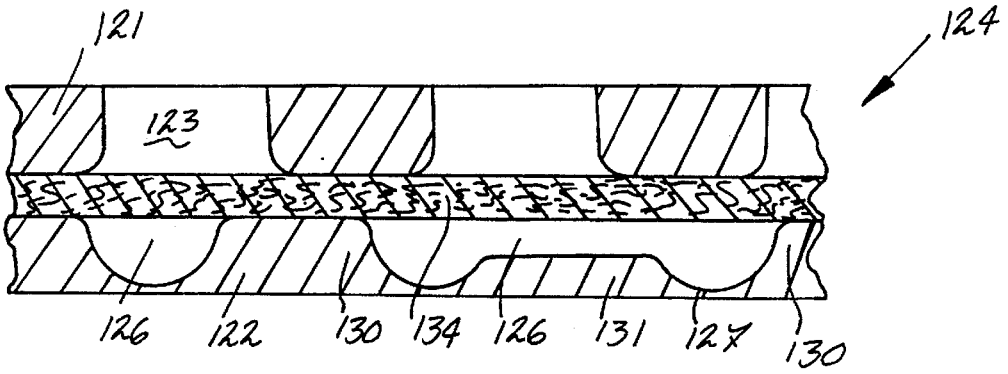
Figure 19:
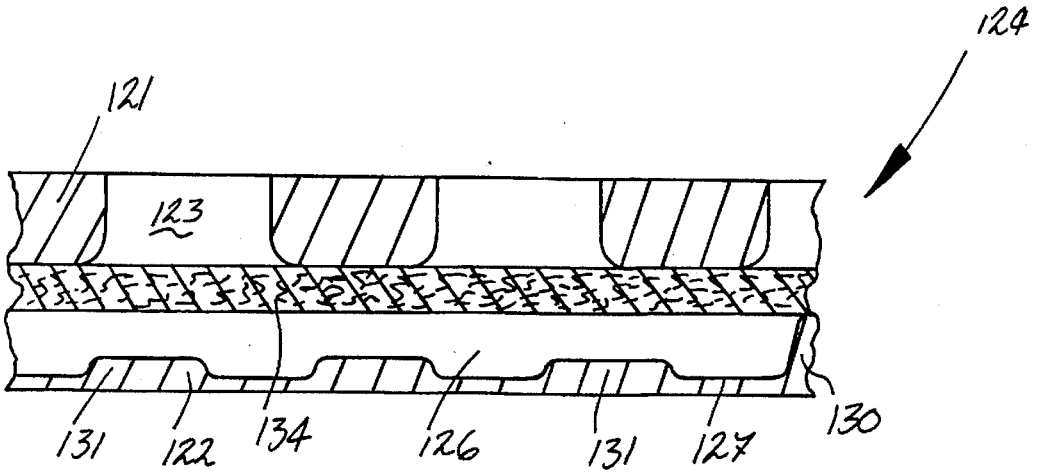
Figure 20:
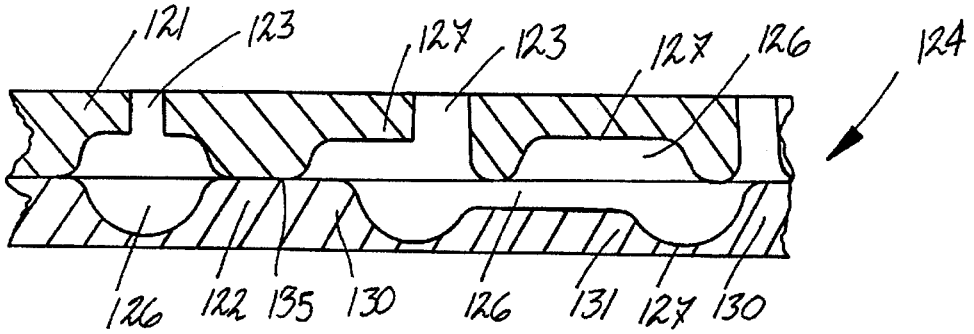
Figure 21:
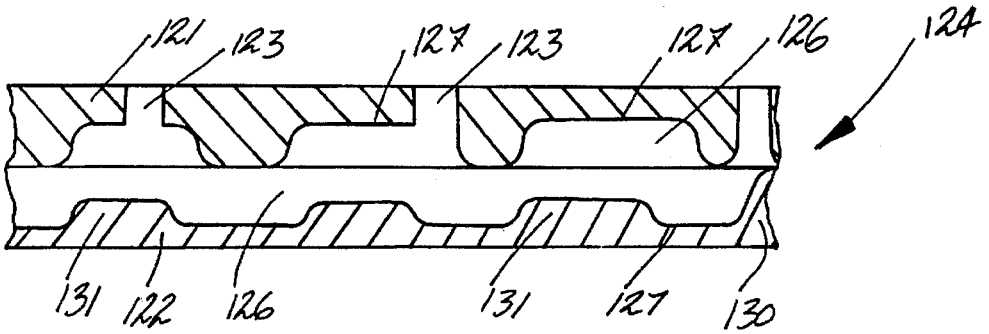
Figure 22:
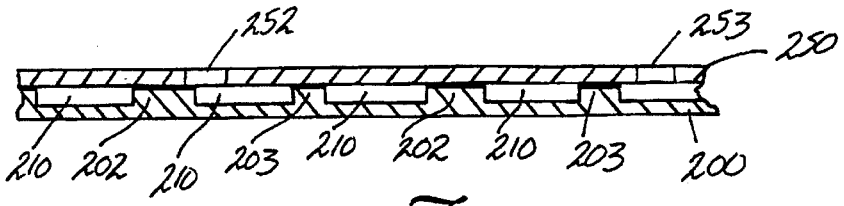
Figure 23:
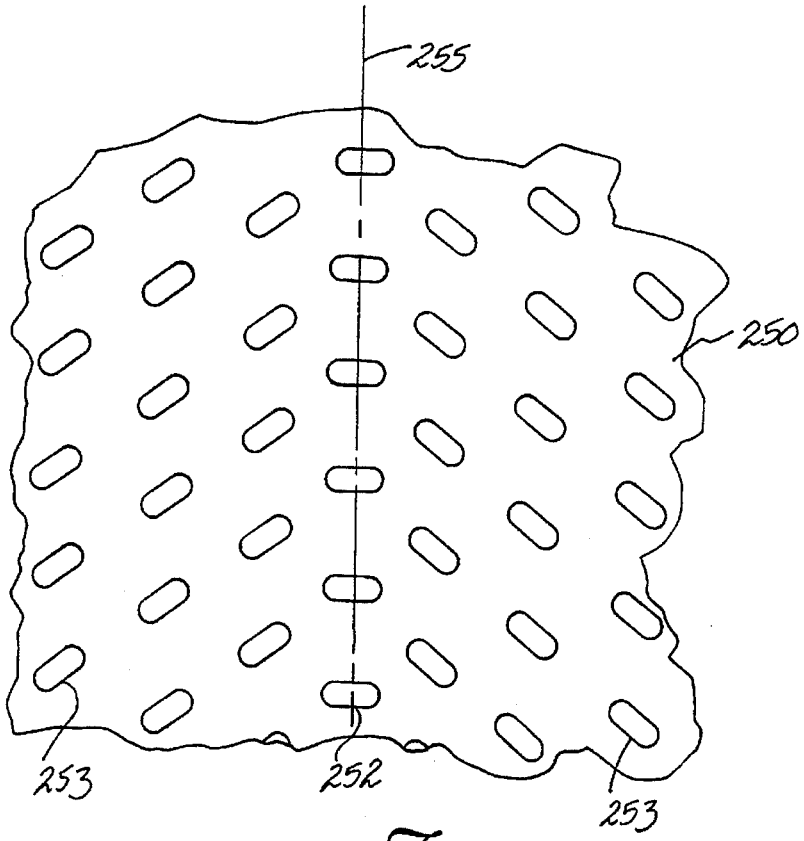
Figure 24:
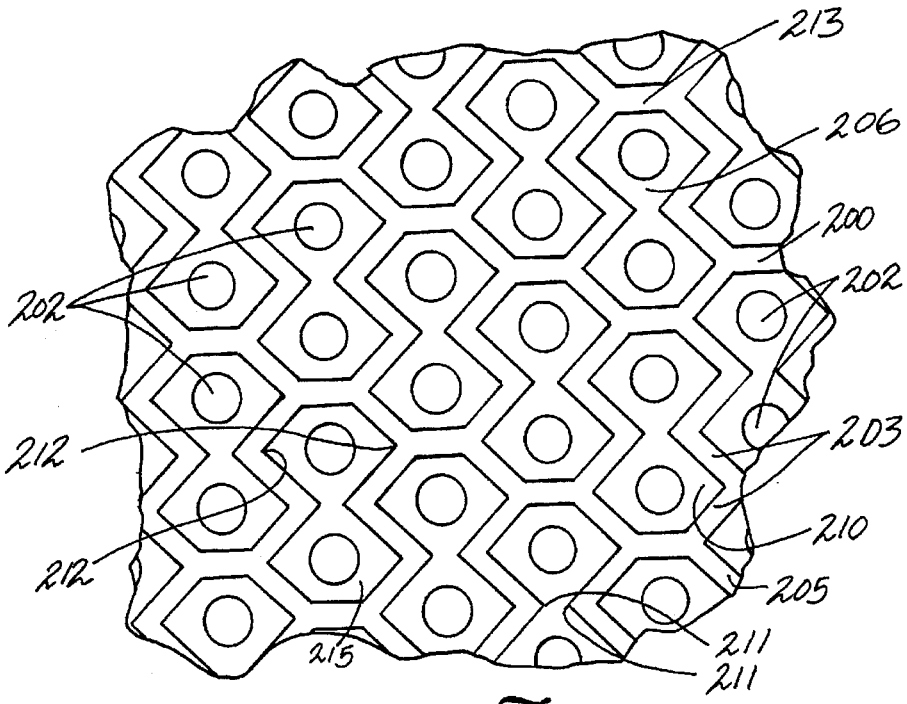
Figure 25:
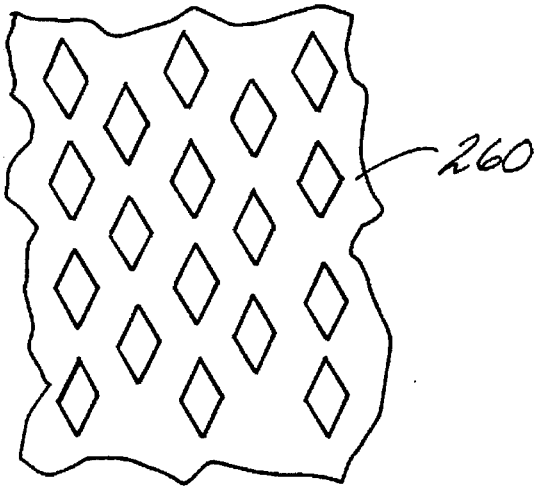
Figure 26:
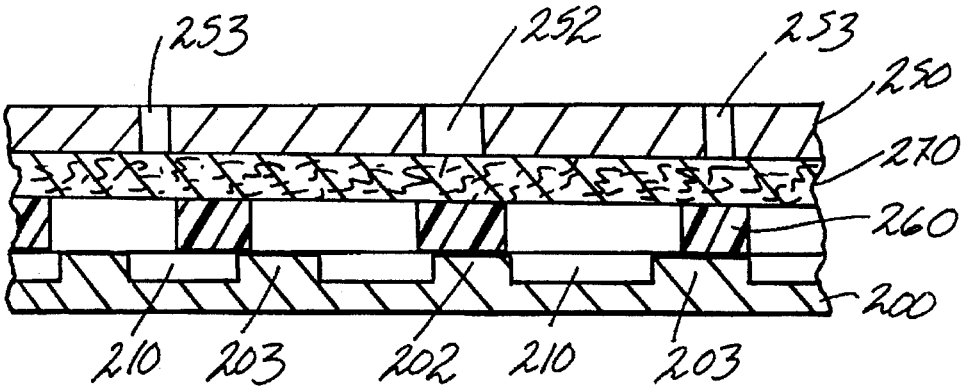
Figure 27:
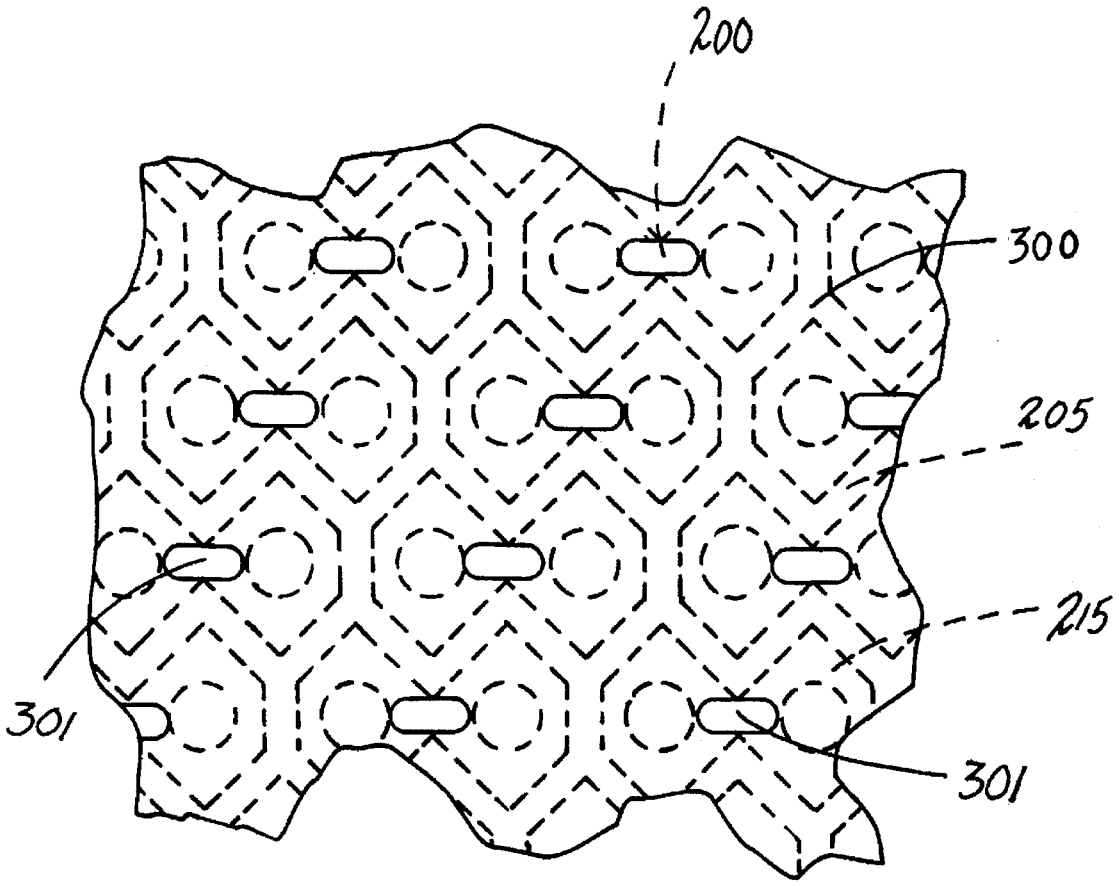
Figure 28:
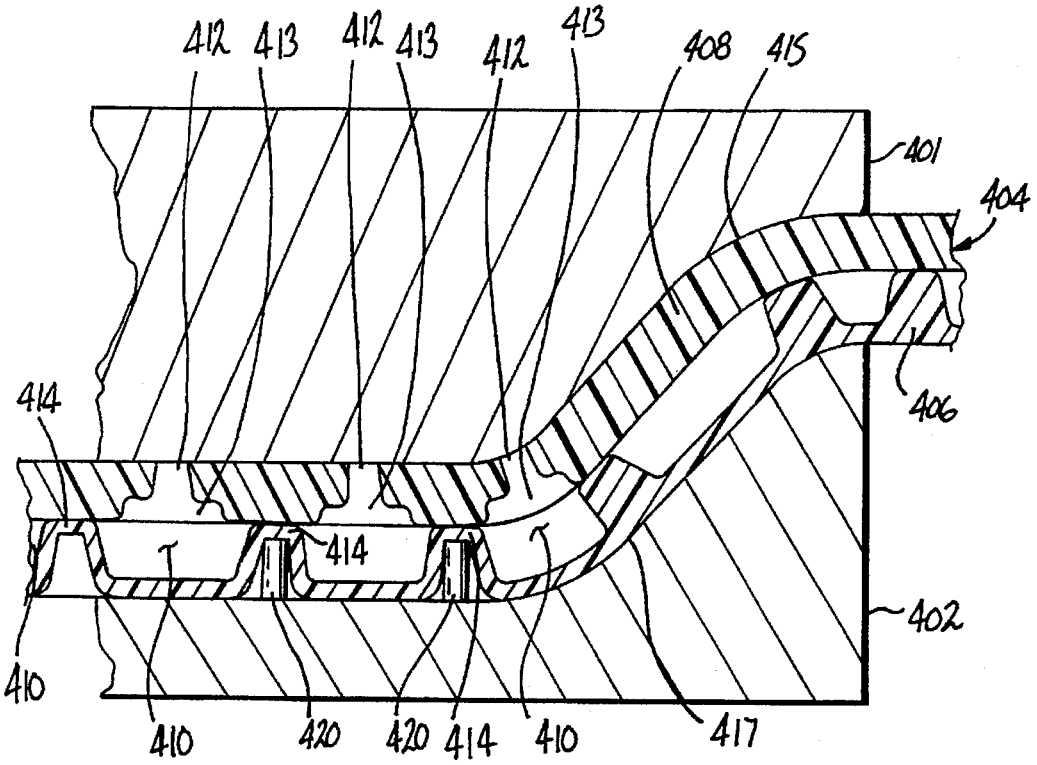
Figure 29:
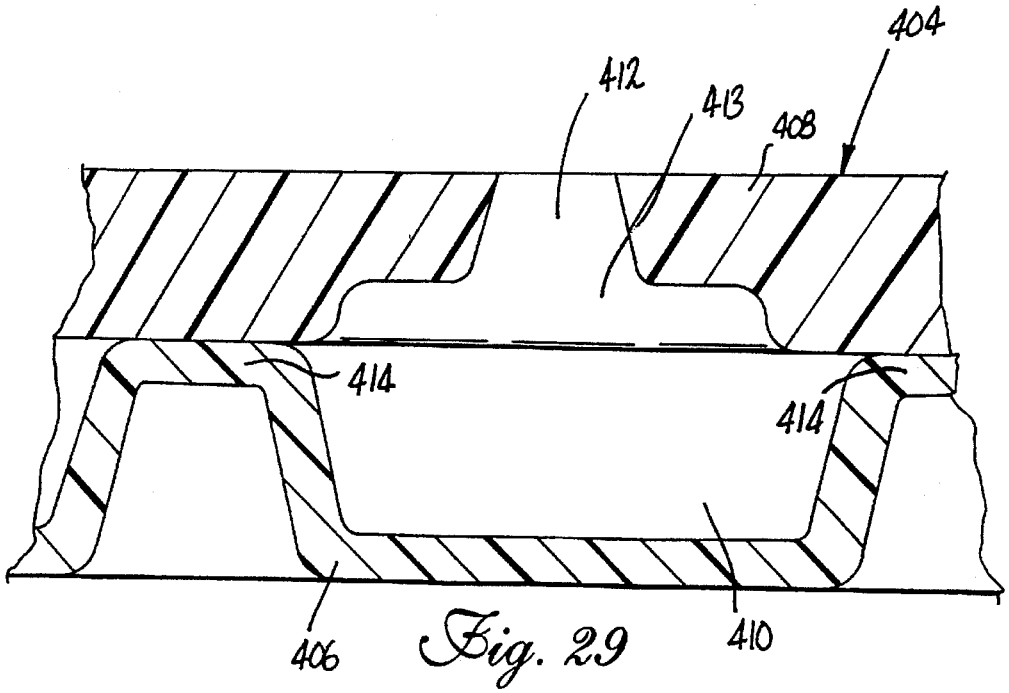
Figure 30:
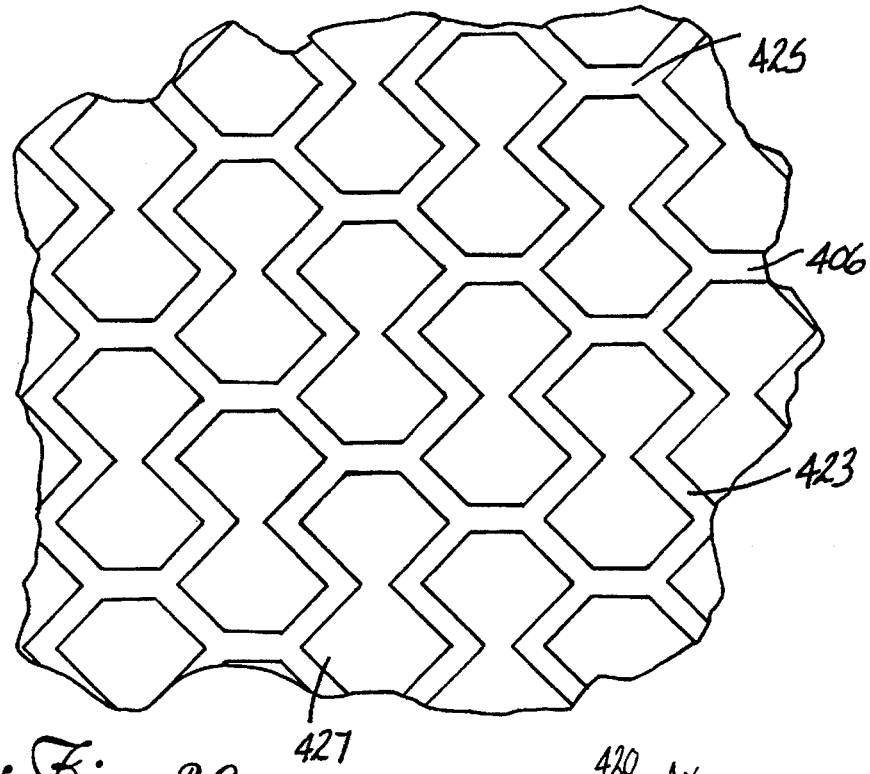
Figure 31:
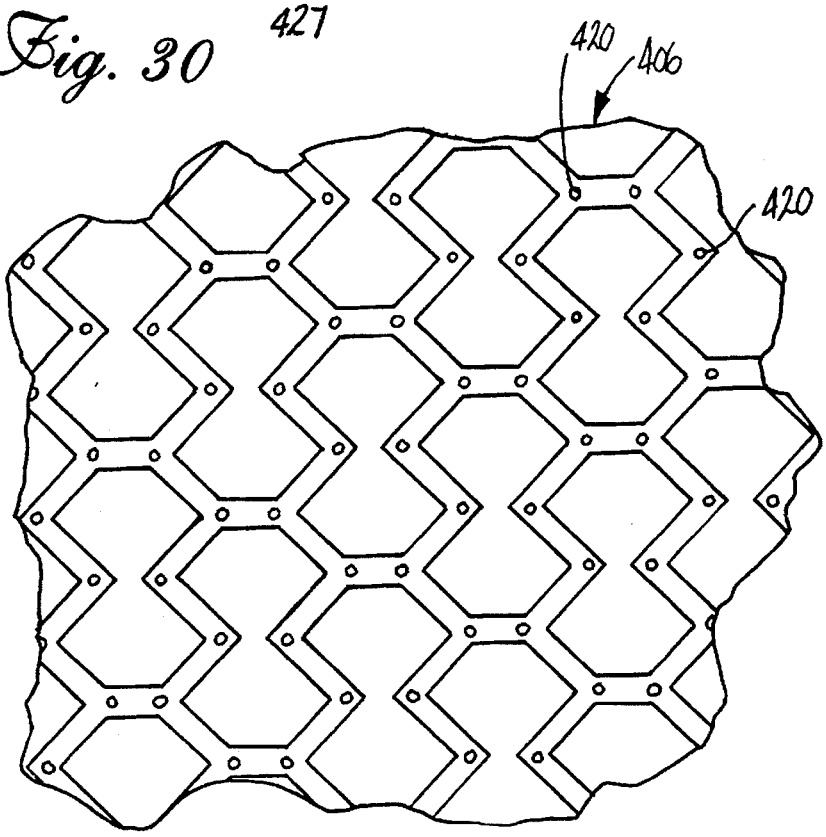
Figure 32:
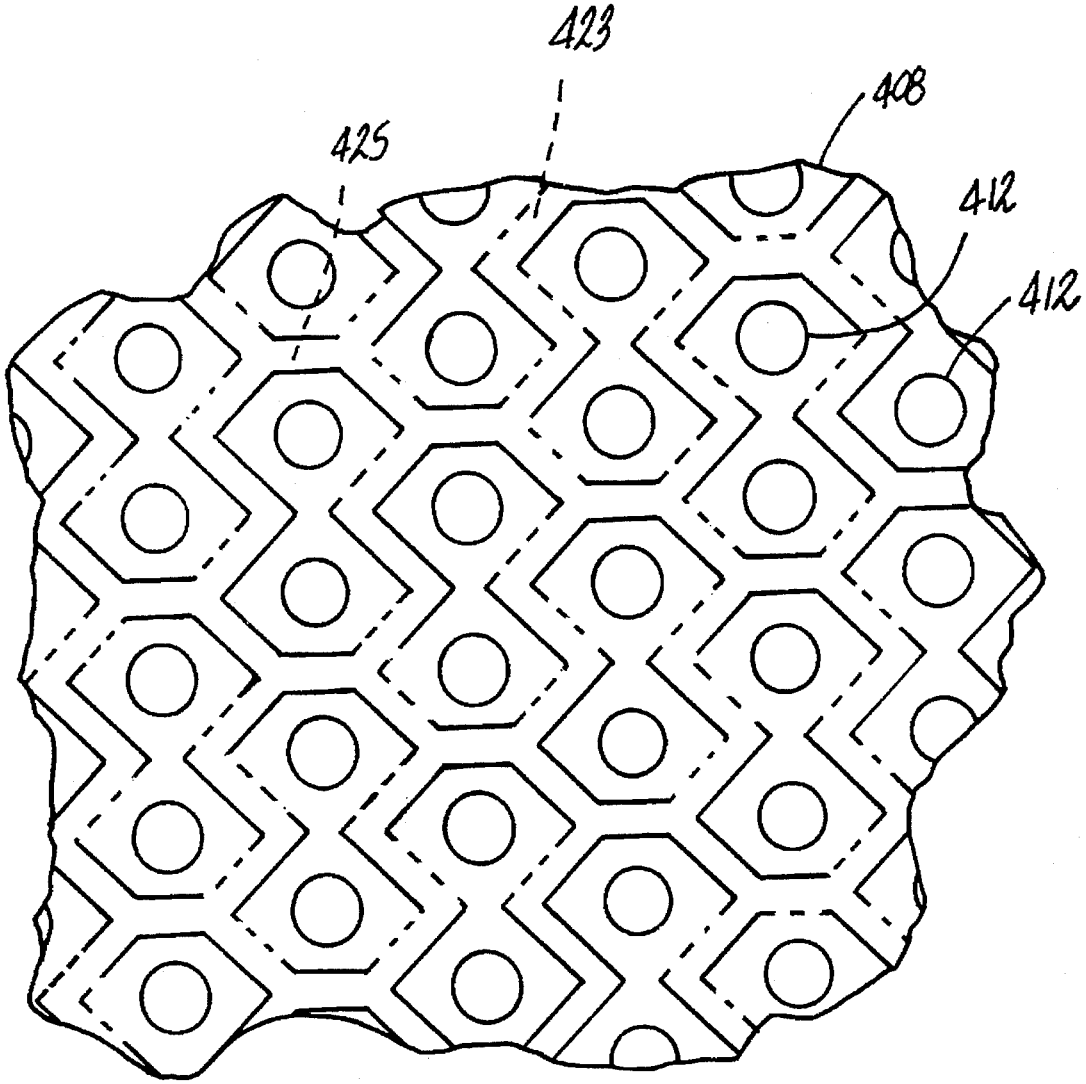

FIG, 17 is a cross section through the tray according to a further implementation example of the invention;

FIG. 18 is an enlarged partial cross section of the tray shown in FIG. 17 similar to FIG. 12;

FIG. 19 enlarged partial cross section of the tray shown in FIG. 17 similar to FIG. 13;

FIG. 20 is an enlarged partial cross section through a tray according to a further implementation example of the invention similar to FIG. 12 and FIG. 18;

FIG. 21 is an enlarged partial cross section through a tray according to a further implementation example of the invention similar to FIG. 13 and FIG. 19;

FIG. 22 is a cross-sectional view of a further embodiment of tray incorporating the principles of the invention;

FIG. 23 is partial plan view of a portion of the upper lamina of the tray of FIG. 22;

FIG. 24 is a partial plan view of the upper surface of the lower lamina of the tray in accordance with FIG. 22;

FIG. 25 is a plan view of a reticulate lamina;

FIG. 26 is a cross-sectional view of a further embodiment of a laminate in accordance with the invention;

FIG. 27 is a partial plan view of a particular embodiment of a laminate in accordance with the invention;

FIG. 28 is a partial cross-sectional view of a male and female die together with a portion of a tray being formed;

FIG. 29 is a partial cross-sectional view of a laminate formed by the dies of FIG. 28;

FIG. 30 is a partial plan view showing an alternate embossment of a lower lamina;

FIG. 31 shows a preferred arrangement of high pressure points in the lamina of FIG 30; and FIG. 32 shows a preferred arrangement of openings in an upper lamina in register with fluid retaining cells in the lower lamina shown in FIG. 30.

DETAILED DESCRIPTION

Figure 1:
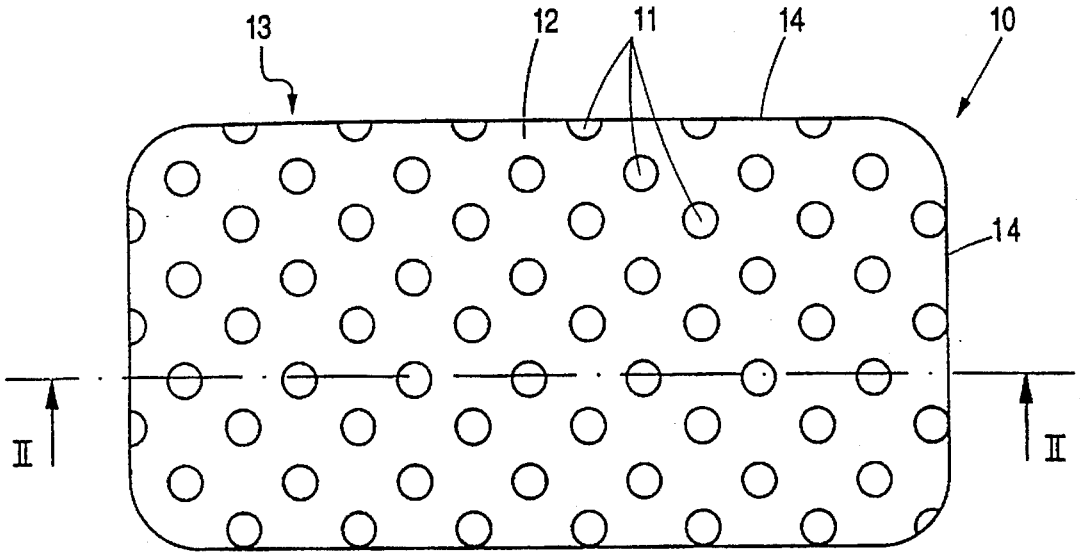
FIG. 1 is a top view of a tray in accordance with the invention.

FIG. 1 shows a top view of a tray 10 in accordance with the invention. The tray 10 is made of two laminae with fully-penetrating openings 11 in an upper lamina 12 and consists of a foamed, watertight synthetic material, preferably polystyrene. Other materials, for instance only temporarily watertight materials, may be used.

Figure 2:
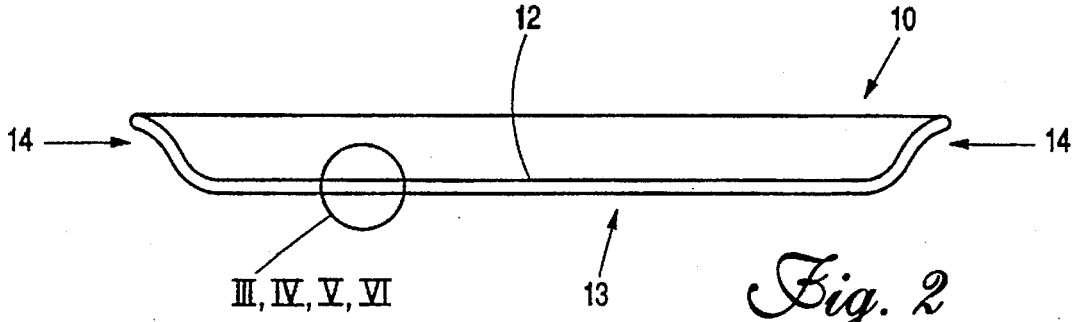
FIG. 2 is cross section through the tray of FIG. 1.

The tray 10 has a bottom element 13 as well as an adjoining raised peripheral tray edge 14. The tray edge 14 is shown more dearly in the cross-sectional view of FIG. 2. The openings 11 are distributed across the entire upper lamina 12 and are, therefore, also located in the area of the tray edge 14. FIG. 2 is a simplified representation and the individual laminae and the openings 11 are not shown in FIG. 2.

Figure 3:
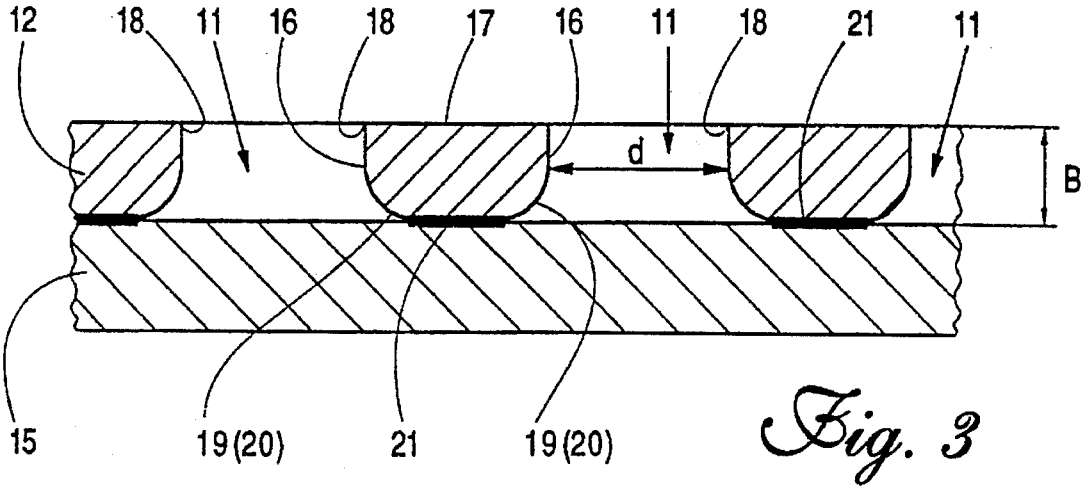
FIG. 3 is an enlarged representation of a portion of the cross section in FIG. 2.

FIG. 3 is an enlarged, cross-sectional representation of a portion III of FIG. 2. FIG. 3 shows the upper lamina 12 and a lower lamina 15 that is connected to it, as well as of the placement and form of the openings 11. The upper lamina 12 forms the underlayment for a food item, for instance a portion of meat, in the tray. In the upper lamina 12 the openings 11 are provided at essentially regular distances from one another. These are, for instance, circular and oriented vertically into the plane of the lamina 12. Based on a cylindrical form, the openings 11 are equipped with a circumferential edge 18 at the transition from a circumferential opening surface 16 and a top surface 17 of the upper lamina 12. In the lower area of lamina 12, toward the lower lamina 15, the openings 11 have a circumferential rim 20 with a radius 19, such that the diameter of the openings 11 is greater in the area adjacent to the lower lamina 15 than near the top surface 17. The radius of the opening preferably measures about 0.25 to 2 mm immediately adjacent lamina 15.

In the region outside of the radius 19 of rim 20, the openings 11 have an average diameter of 5 to 8 mm. Preferably, the relationship of the opening diameter d outside of radius 19 to the thickness B of the upper lamina 12 is such that the diameter is approximately two to four times larger than the thickness of the lamina 12. Deviations from this, particularly down to 0.5 times the thickness, may be used.

In one configuration, not shown in the drawing, the openings have alternatingly different diameters, so that smaller and larger holes are alternatingly positioned in one row along the length of the tray 10. Moreover, adjacent rows may be offset from one another by one-half of the opening-opening distance.

In the version of the tray described so far, the two laminae 12 and 15 are firmly joined with one another in connection areas 21, by welding or gluing. In FIG. 3, such connection areas 21 are shown as thick black lines. The connection areas 21 each extend over the areas in which the laminae 12 and 15 contact one another. It is desirable that the lower end areas of the radii 19 are not included in the connection areas 21 since liquid is held in the region of the radii 19 by capillary effect.

Figure 4:
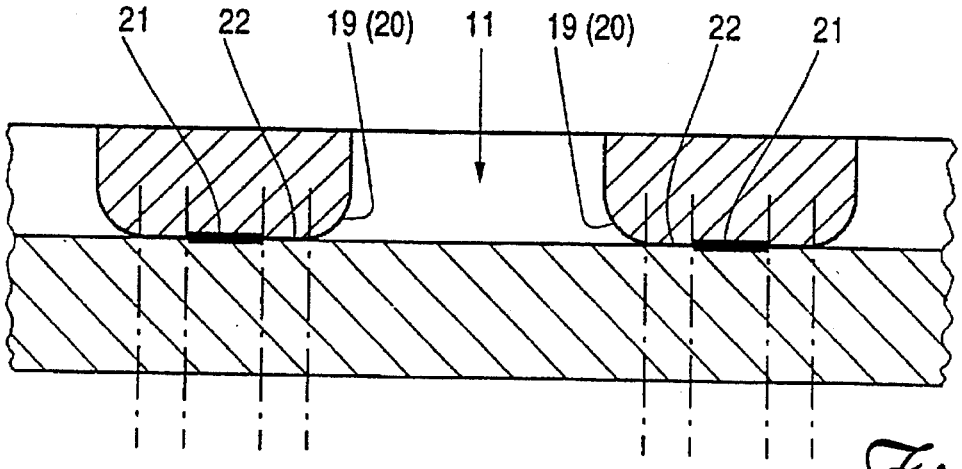
FIGS. 4 and 5 are modified versions in a representation analogous to FIG. 3.
Figure 5:
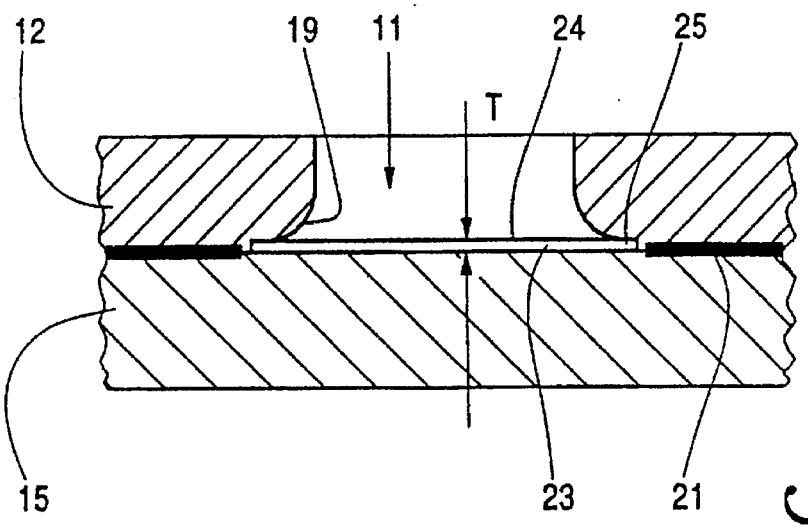

Variations of the embodiment shown in cross section in FIG. 3 are shown in FIGS. 4 and 5. In the arrangement accordance with FIG. 4, the connection areas 21 between the openings 11 are preferably comparatively narrow. This results in circumferential, ting-shaped, and unconnected side areas 22 adjacent to the radii 19. The width of these is indicated by dash-dotted lines in FIG. 4. Liquid penetrates into these side areas 22, thereby further increasing the liquid retention capacity of the tray 10.

In the arrangement accordance with FIG. 5, a cylindrical depression 23 is provided in the area of the radius 19 facing the lower lamina 15. The edge thereof facing the radius 19 is denoted with the number 24. Through the depression 23, an additional cavity 25 for retaining liquid is formed between the lower lamina 15 and the upper lamina 12 near the connection areas 21. The depth T of the depression 23 preferably lies within approximately 0.1 to 0.5 times the thickness B of the upper lamina 12.

Figure 6:
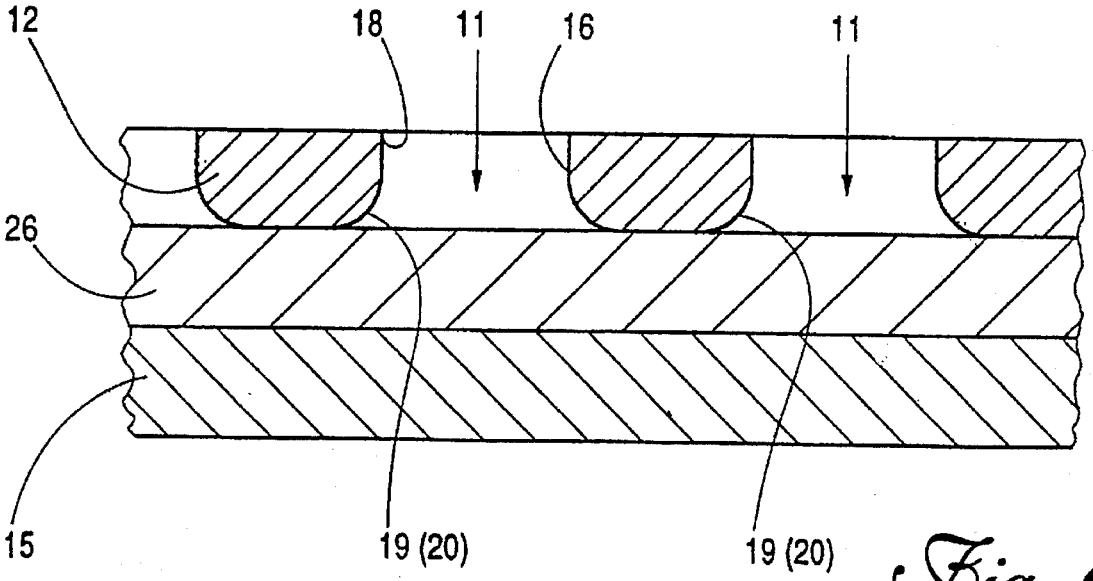
FIG. 6 is a further modification analogous to FIG. 3, with an additional absorbent inset.

FIG. 6 shows an alternate arrangement with an absorbent lamina 26 disposed between the upper and lower laminae 12 and 15. The openings 11 are equipped with a circumferential rim 20 with the radius 19 in the lower area as described above. Because the openings 11 widen toward the bottom, the liquid that is present can be absorbed more quickly by the absorbent lamina 26. At the same time, the absorbent lamina can expand into the enlarged openings formed by the rim 20 in the area immediately adjacent the absorbent lamina 26.

Figure 7:
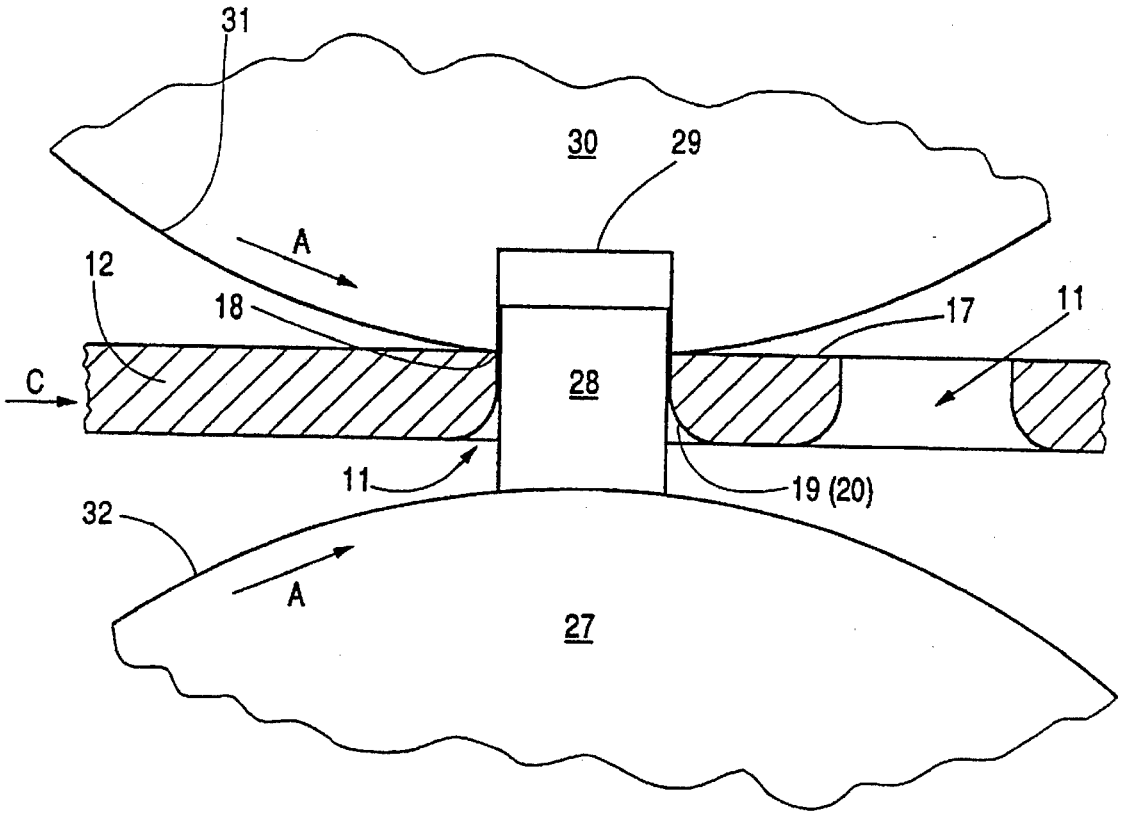
FIG. 7 is a schematic representation of the process of the openings 11 shown in FIGS 3 through 6.

FIG. 7 illustrates the manufacture of the individual openings 11 in the upper lamina 12. Each of the openings 11 is stamped out by a punching tool 27 having a punch 28 which acts in conjunction with an opposing stencil 29 in a stencil holder 30. Punching tool 27 and stencil holder 30 are arranged around an axis, not shown in the drawing, rotating in the direction of the arrows A. Additional stencils 29 and punches 28 are arranged on the perimeters 31 and 32 of the stencil holder 30 and punching tool 27, respectively. These are not shown in the drawing for the sake of clarity. The lamina 12 is fed between the punching tool 27 and the stencil holder 30 as a continuous strip of material in the direction of the arrow (C). The relative positioning of the punch 28 to the upper lamina 12 is important. The punch 28 penetrates the upper lamina 12 from the side opposite the top surface 17. In materials with a certain softness, such as polystyrene, this punching process forms the rim 20 with the radius 19. In the region of the top surface 17, on the other hand, where the punch 28 penetrates the stencil 29, the relatively sharp circumferential edge 18 is formed. The special shape of the openings 11 for retaining liquid is thus achieved in a simple manner. After the openings 11 have been formed, continuous strips of the upper lamina 12 and the lower lamina 15 are joined in the connection areas 21. Advantageous connection methods are described above through FIG. 3, 4, and 5. The depression 23, shown in FIG. 5, can be formed before or after the punching process. In the case of a meltable material, for example, polystyrene, this can be accomplished by means of a heated forming tool and before the punching process.

After the completion of the upper lamina 12, it is joined with the lower lamina 15 and cut to the desired size. Finally, the raised peripheral tray edge 14 is formed in a well-known deep-drawing process and the tray 10 is brought to its final form. In this manner, the effect of the openings 11 widening toward the bottom is further amplified.

Figure 8:
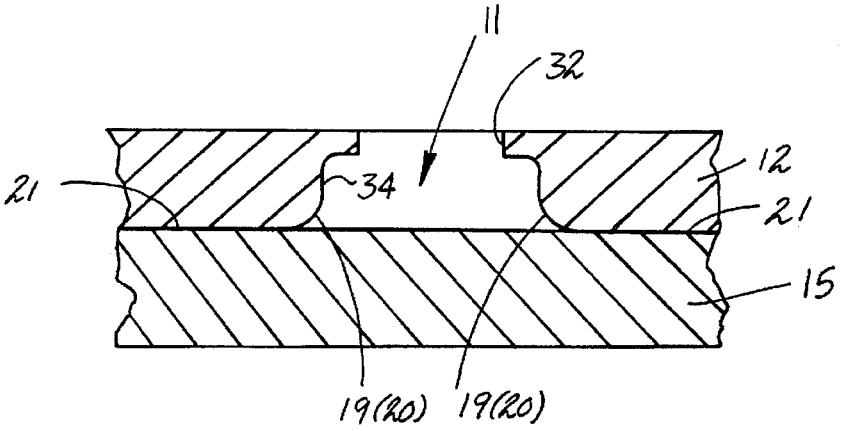
FIG. 8 is an enlarged cross-sectional view of an alternate construction of one of the openings 11.
Figure 9:
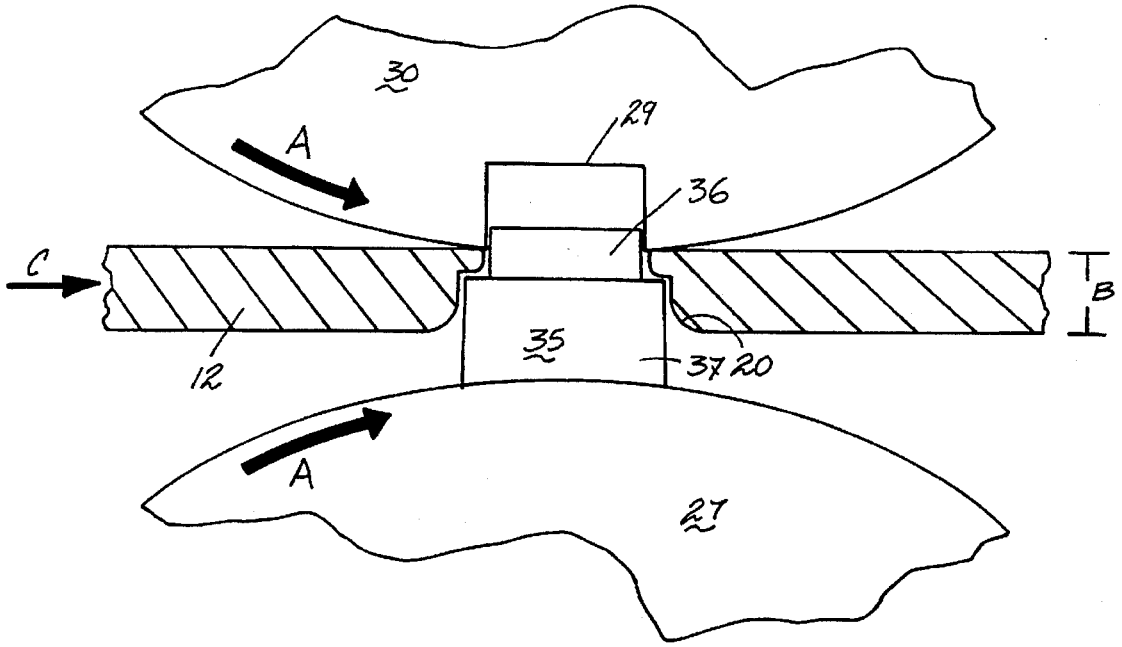
FIG. 9 is a schematic of the process of forming the openings 11 shown in FIG. 8.

FIG. 8 shows an alternate arrangement of the cavity 11 with an upper cylindrical section 32 and lower cylindrical section 34. The lower cylindrical section has a diameter greater than the upper cylindrical section. In this arrangement, the fluid retention capacity of the cavity 11 is increased without enlarging the opening in the upper surface on which a food item will be placed. FIG. 9 shows a punch 35 with an upper section 36 which extends into the stencil 29 by a distance sufficient to assure piercing of the upper surface of the lamina 12. A lower section 37 of the punch 35 has a greater diameter than the upper section 36 and extends into lamina 12 by a distance which is approximately ⅔ of the thickness of lamina 12. As described earlier with reference to FIG. 7, a rim 20 is formed by the punching process in materials such as polystyrene.

The tray 120 shown in FIGS. 10 through 16 consists of two laminae. It is composed of an upper lamina 121 and a lower lamina 122. The laminae 121 and 122 have approximately the same thickness. The upper lamina 121 is oriented toward the packaged goods (not shown in the drawing) and has fully penetrating apertures or openings 123. The openings 123 are distributed evenly over the bottom 124 of the tray 20. The openings 123 open toward the lower lamina 122 and terminate sharply on the side facing the packaged goods as depicted in FIGS. 12 and 13. The diameters of the openings 123 is preferably so small that the openings achieve a capillary effect. In the preferred implementation of the invention shown here, no openings 123 are provided in the area of the longitudinal side walls 125 of the tray 120. However, openings 123 are provided in the area of the end walls 129. The openings 123 are preferably spaced equidistantly in the longitudinal direction of the tray. In the transverse direction they are shifted center to center relative to one another in such a manner that an opening 123 is positioned halfway between two openings in the row above or below. The openings 123 may be positioned at least in the end side walls 129 of the tray 120.

In the interior of the tray 120 there are cavities 126. The cavities 126 are formed by impressions 127 in the lower lamina 122. The impressions 127 present decreases in the thickness of the lamina 122 in certain areas. This way the cavities 126 are accommodated within the lamina 122, and that is without the necessity that the thickness of the lamina 122 be increased in respect to the lamina 121. The cavities 126 stretch across the entire area of the floor piece 124. In the preferred implementation example of the invention shown here, no cavities 126 are positioned in the area of the longitudinal side walls 125 of the tray 120. However, cavities 126 are positioned at the end side walls 129 in addition to the openings 123. Through this implementation form of the invention it is guaranteed that the laminae 121, 122 will have continuous contact and connection at least in the area of the longitudinal side walls 125 of a tray 120.

The cross sections of FIGS. 12 and 13 illustrate the cavities 126, which are formed by compressed areas 127 in a portion of the lower lamina 122, oriented toward the upper lamina 121. The upper lamina 121 is provided with frilly penetrating openings 123 and covers the cavities 126 from above. In the area of the upper lamina 121, the openings 123 are arranged in such a way that liquids that are exuding from the food can drain into the cavities 126 formed by the lower lamina 122. The areas 127 have (FIGS. 3 and 4) differing depths. The cavities 126 are separated from one another by areas free of compressed areas, referred to as walls. In the area of the enclosures 130, the upper lamina 121 and the lower lamina 122 are connected to each other at connecting surfaces 135. The cavities 126 are furthermore equipped with baffles 131. The height of the bridges 31 is less than the depth of the cavities 126.

In another embodiment of the invention, cavities 126 are formed by compressed areas 127 in the upper lamina 121 as well as in the lower lamina 122 of the tray 120, as shown in FIGS. 20 and 21. The openings 123 in the upper lamina 121 are formed with a particularly small diameter to enhance the capillary action of the openings 123 and prevent the fluids that have been received by the cavities 126 from flowing back into the interior of the tray 120.

Figure 10:
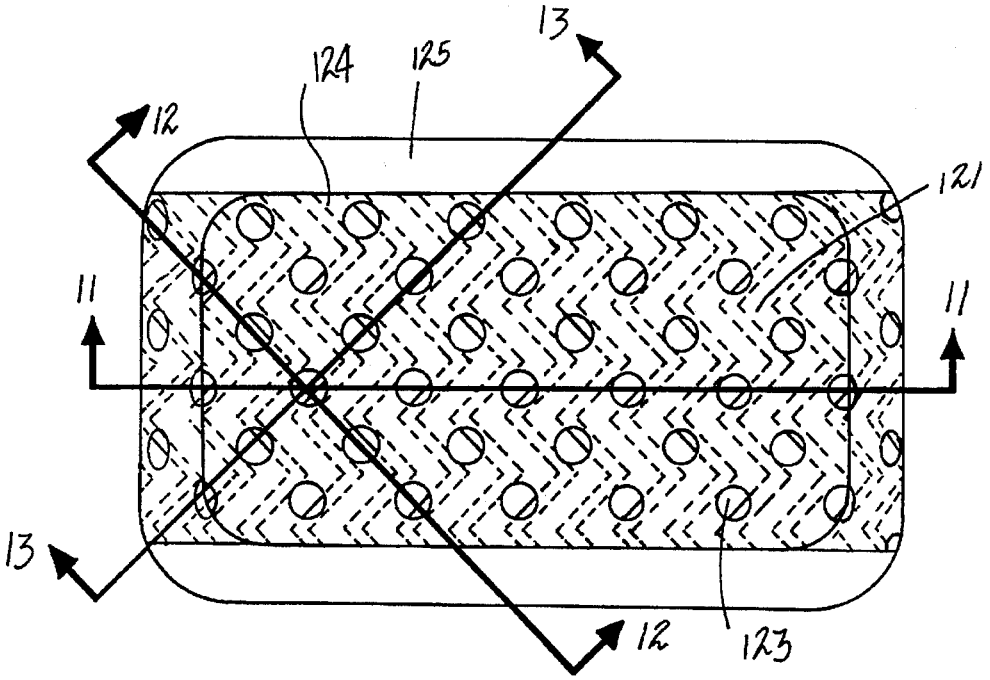
FIG. 10 is a plan of an alternate embodiment of a tray incorporating the principles of the invention.
Figure 11:
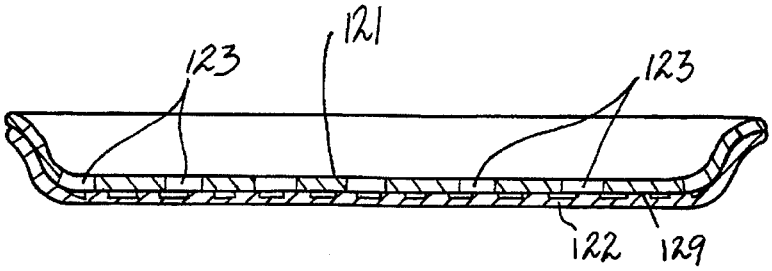
FIG. 11 is a cross section 11—11 through the tray of FIG. 10.
Figure 14:
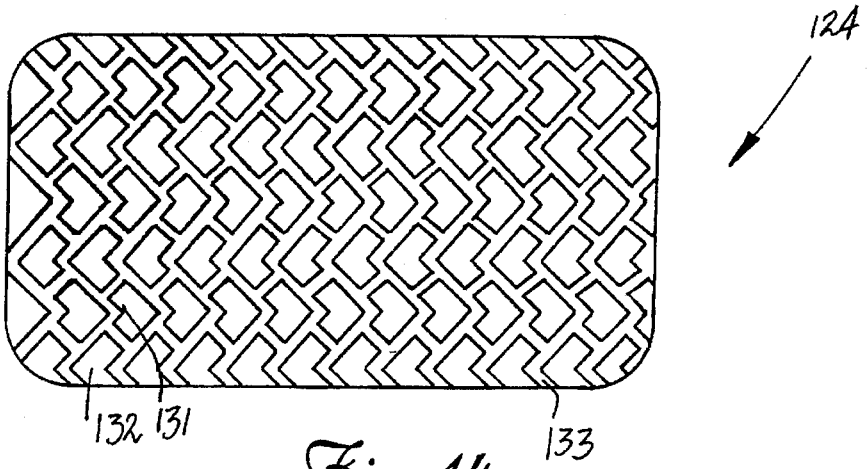
FIG. 14 is a pattern of the impressions in the floor area of the tray according to the FIGS. 10 and 13.

FIGS. 10 and 14 show a first variation of the arrangement of compressed areas 132 and uncompressed areas 133 (shown as blackened areas in the figures) in the floor piece 124 of the tray 120. These areas run diagonally over the material strip and thus form arrow-shaped structures of compressed areas 132 and uncompressed areas 133. They preferably extend at an angle of approximately 45 degrees to the longitudinal side walls. The material strip is preferably not compressed in the area of the longitudinal side walls. This way the lower lamina 122 and the upper lamina 121 fully rest on one another in the area of the longitudinal side walls 125 to form sufficiently large connecting surfaces 135. In the area of the end side walls 129 the material strip is provided with compressed and uncompressed areas. FIG. 14 shows an arrangement of the baffles 131. The bridges 31 subdivide the cavities 126 formed by the compressed areas 132. For reasons of clarity of the drawing, the baffles 131 are only shown in two of the compressed areas 132. Any desired arrangement of the baffles 131 is possible.

Figure 15:
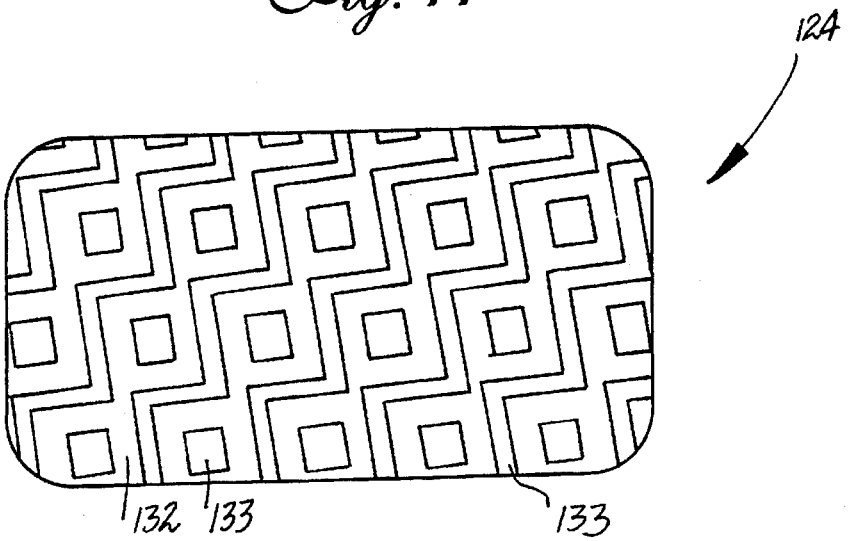
FIG. 15 is a pattern of the impressions in the floor area of the tray according to a different implementation example of the invention in a view analogous to FIG. 14.
Figure 16:
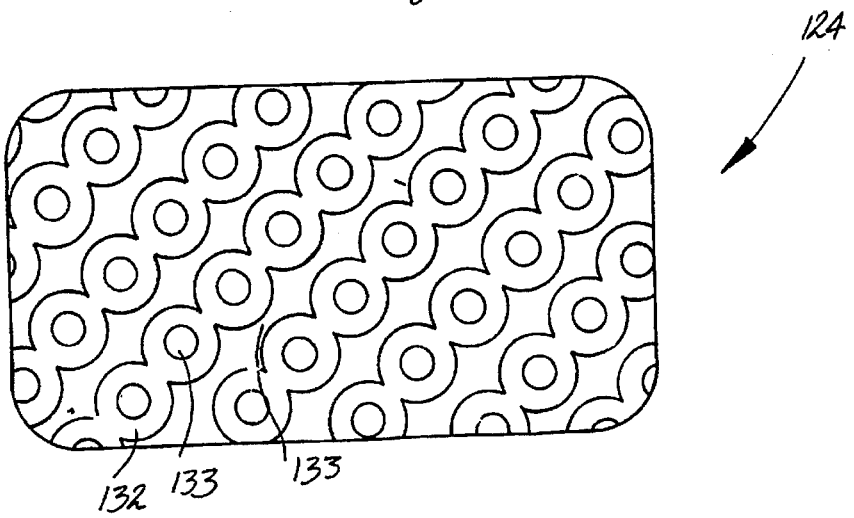
FIG. 16 is pattern of the impressions in the floor area of the tray in another implementation example of the invention in a view analogous to FIG. 14 or 15.

In a second variation of the arrangement of compressed areas 127 on a material strip of the tray 120, the uncompressed areas 133 progress in a stepped manner and diagonally across the material strip as depicted in FIG. 15. They enclose further uncompressed areas 133 of rectangular form. In a further implementation of a material strip provided with compressed areas 127 forming the tray 120, the compressed areas 132 form ring-shaped structures, each of which is connected with two neighboring ring-shapes thereby forming a chain-link structure that progresses diagonally across the material strip as shown in FIG. 16. The individual chain-link structures are separated from one another by uncompressed areas 133. The baffles 131 can be arranged in any desired way. For reasons of clarity of the drawings, baffles 131 are not shown in FIGS. 15 and 16.

The position of the openings 123 in the upper lamina 121 is coordinated with the arrangement of the compressed areas 127 in the lower lamina 122. The openings 123 are arranged to be directed to the cavities 126 and sufficiently large connecting surfaces 135 are provided for interconnecting the upper lamina 122 and the lower lamina 122 in the area of the walls 130.

The special form of the cavities 126 is guaranteed by the process of this invention for manufacturing the tray 120. At least one material strip, in particular the one that forms the lower lamina 122 of the tray 120, is compressed in certain areas to create the cavities 126. Compressed areas 132 are separated from one another by uncompressed areas 133. The uncompressed areas 133 later form the enclosures 130 of the cavities 126. In the uncompressed area 133, the synthetic foam retains its original structure. This means that the air chambers enclosed within the synthetic foam remain intact. In the areas of compressed area 127, the structure of the synthetic foam is destroyed either entirely or partially, depending on the degree of compression. If the air chambers enclosed within the synthetic foam are removed entirely, one speaks of maximum compression, located in the areas of the cavities 126 between the baffles 131. In less strongly compressed areas, such as the areas of the baffles 131, some of the air chambers enclosed within the synthetic foam remain intact. This is called partial compression. The compression of the material strip occurs in a roller gap between two rotating parallel rollers. The roller sleeve of one roller is equipped with projections that correspond to the areas of the material strip that are to be compressed. The sleeve surface of the counter roller is smooth, i.e. without projections. The height of the projections on the sleeve surface of the roller equipped with projections corresponds to the degree of the compression that is to be effected. After the compression, the material strips are connected to each other, for example by welding, and are deformed together, for example through deep drawing. The material strips can also be connected with one another through sealing and gluing. During the deformation, partial compression is partially reversed. These areas form the baffles 131 of the cavities 126.

FIG. 17 shows a tray 128 incorporating the principles of the invention wherein a lamina 134 of absorbent material is disposed between the upper lamina 121 and the lower lamina 122 at least in certain sections of the tray. The absorptive insert increases the capacity of the tray for retaining fluids exuding from the packaged food.

The FIGS. 18 and 19 show an enlarged detail cross section of the tray 128. In that arrangement, the cavities 126 are covered from above by the absorbent insert 134. The upper lamina 121 is provided with fully penetrating openings 123. While absorbent insert is formed without openings and thus prevents the fluids received by the cavities 126 from flowing back into the interior of the tray 128.

FIG. 22 is an enlarged partial cross-sectional view of an alternate structure for the bottom element of a tray for the containment of liquid-secreting foods. The bottom element corresponds to the element 13 of the tray 10 shown in FIG. 2. The bottom element is a laminate which may consist of from two to four laminae. The present configuration has an upper lamina 250 which is positioned adjacent the meat or other items packaged in the food tray. A top view of a portion of the lamina 250 is shown in FIG. 23. The upper lamina 250 is provided with a number of oblong-shaped apertures 252, 253 penetrating its upper and lower surfaces. The apertures allow fluid to flow from the packaged item to the lower lamina 250.

The lower lamina 200 is provided with a number of fluid retaining channels 210 which are separated by longitudinally extending walls 205.

FIG. 24 is a top view of a portion of the upper surface of the lower lamina 200 showing the fluid retaining channels 210 and the walls 205. A plurality of wall sections 203 are interconnected in a longitudinal direction to form the walls 205. The wall sections 203 extend at substantially right angles to each other and the wall sections 203 of adjacent walls 205 are positioned relative each other such that the exterior angles 211 of adjacent walls 205 are opposite each other and the interior angles 212 of adjacent walls 205 are opposite each other, thereby forming a plurality nearly square liquid retaining cells in each of the channels 210. Baffles 213 interconnecting adjacent wall sections at selected positions, preferably between adjacent exterior angles 211. The baffles 213, together with the wall sections 203 define a plurality of liquid retaining cells 215. Liquid received at the bottom lamina 200 through openings 252, 253 in the top lamina 250 is retained in each of the cells. The baffles 213 are preferably somewhat lower in height than the wall sections 213 in order to allow for an overflow between adjacent cells.

FIG. 24 shows each cell consisting of two substantially square areas formed between adjacent walls 205. The placement of the baffles 213 may be adjusted such that a cell is formed from one or more such squares. Within each of the square areas 206 is a pad 202. The pads serve to provide an area for bonding of the top lamina 250 to the bottom lamina 200. The two laminae may be bonded together along the wall areas 203 as well, as represented by heavy black lines in FIG. 22.

The liquid retaining spatial areas, or cavities, may be formed in the lower lamina 200 by an embossing process, for example, by compressing a sheet of polystyrene between two opposing rollers, as described earlier herein. A pressure of approximately 80 kg per cm of line contact may be used on a sheet of fresh foam, cooled to room temperature.

FIG. 23 shows a particular pattern of elongated openings or slits in the upper lamina 250. These include a plurality of slits 252 spaced apart along the centerline of the upper lamina by a distance somewhat greater than half of the length of one of the cells 215. On each side of the centerline is a pattern of spaced-apart parallel slits 253 having a longitudinal dimension extending at an acute angle to the center line. The longitudinal dimension of the slits 252, 253 is preferably somewhat greater than the width of the walls 205.

In an alternative arrangement, a reticulate lamina 260 is inserted between the lower lamina 200 and the upper lamina 250 to further increase the liquid retaining space between the two laminae. The thickness of the lower lamina 200 and the reticulate lamina 260 is preferably greater than the thickness of the top lamina 250 in order to increase the fluid retaining space without increasing the total thickness of the tray more than necessary. FIG. 25 is a top view of an area of the reticulate lamina 260.

In a further alternate arrangement, an absorbent lamina 270 is inserted between the bottom lamina 200 and the top lamina 260. The absorbent lamina is preferably formed of a non-woven absorbent material and may be formed from any number of commercially available super-absorbent chemicals or gels. A wicking agent may be added to the absorbent lamina to facilitate the movement of liquid away from the packaged food to the region of the lower lamina. Advantageously, the tray in accordance with this invention removes liquids from the area of the packaged food and out of sight of the purchasing consumer.

FIG. 26 is a partial cross section of the bottom element of a food tray showing the lower lamina 200 with the fluid retention cavities 210 as well as the reticulate lamina 260 and the absorbent lamina 270 between the top lamina 250 and the lower lamina 200. Either the reticulate lamina 260 or the absorbent lamina 270 may be inserted alone between the bottom lamina 200 and the top lamina 250 or they may both be used as shown in FIG. 26.

The top lamina 250 may be formed by the use of a punch die in a well known fashion. The reticulate lamina 260, shown in top view in FIG. 25, may similarly be formed by the use of a punching die or by stretching of a slitted material. The top lamina 250 and the reticulate laminae are preferably made out of a non-absorbent foamed synthetic material such as polystyrene. The reticulate lamina 260 and absorbent lamina 270 may be treated with a wetting agent to facilitate conducting liquids away from the packaged material.

FIG. 27 is a partial plan view of an alternate arrangement of a lower laminate for a tray. The laminate has a lower lamina 200 formed with liquid retaining cells 215 as shown in FIG. 24 and an upper lamina 300 formed with elongated openings or slits 301 in register with the cells 215. This arrangement assures proper access to each cell for liquid exuding from the packaged item with a minimum number of slits 301. The slits 301 preferably are positioned at the center of each of the cells 215 to enhance the liquid retaining capability of the tray. By arranging the slits in register with the center of the cells, more liquid will be retained in the cells as the tray is tilted, thereby reducing the mount of liquid that will flow into the visible part of the package. Since the upper and lower laminae are bonded along the walls 205, as described earlier, each cell will be able to contain approximately half its total volume when the to contain approximately half its total volume when the tray is tilted in either the lateral or longitudinal direction.

The laminate of FIG. 27 may be manufactured by first separately forming the two laminae with the slits 301 spaced apart by distances corresponding to the distance between the centers of the cells 215 and subsequently bonding the two laminae in proper alignment by well known registration techniques. Thereafter, the tray may be formed by well known manufacturing practices.

FIG. 28 depicts in cross section a portion of a male die 401 and of a female die 402 with a polystyrene laminate 404 disposed between the two dies. The laminate consists of a lower lamina 406 and an upper lamina 408. The lower lamina is provided with voids or cavities 410 and the upper lamina is provided with holes 412 communicating with the cavities 410. The cavities 410 are separated by raised sections 414 formed on upper surface of the lower lamina by embossing, in a manner described earlier herein. Openings 412 in the upper lamina may be provided with enlarged areas 413 formed in a manner described earlier herein. The male die 401 engages the upper lamina 408 along its upper surface 415 and the female die 402 engages the lower lamina 406 along its lower surface 417. The female die 402 is further provided with a plurality of protrusions, namely, pins 420 extending into the lower surface 417 of the lower lamina 406. The pins are preferable 1 to 2 millimeter in diameter and preferably project from the upper surface of die 402 of a distance of 3 to 6 millimeter.

The two lamina 406, 408 are preferably inserted between the dies 401 and 402 at a suitable elevated temperature such that they are sufficiently pliable to be deformed by the dies. As the dies are moved toward each other, in the deforming process, there will initially be a larger contact area between the upper lamina 408 and the male die 401 than between the lower lamina 406 and the female die 402. The plurality of pins 420 will further tend to keep the lower lamina 406 away from the female die 402. As a result, the upper lamina 408 will cool at a more rapid rate than the lower lamina 406. Thus, the lower lamina 406 will be more readily deformed by the pins 420 than will the upper lamina 408 as pressure is applied to move the male and female die toward each other. Furthermore, a vacuum is preferably applied to the female die to draw the more pliable lower lamina 406 more tightly around the pins 420. In prior arrangements in which conventional male and female dies are used, without the pins 420, pressure tends to be evenly distributed over the two lamina, causing both lamina to be compressed to a certain extent. By providing the pins 420, a greater pressure is applied to the lower lamina in specific regions or pressure points, causing deformation in these areas and resulting in a lower pressure over the total surface area. Consequently, there is less over all compression, particularly in the areas defining the cavities 410. Furthermore, since the upper lamina 408 tends to cool faster than the lower lamina 406, due to the presence of the pins 420, the upper lamina 408 tends to be compressed to a lesser extent than the lower lamina 406 and the enlarged areas 413 are reduced to a much lesser extend than in a conventional male and female die arrangement. FIG. 29 is a partial cross-sectional view of the laminate 404 after it has been removed from the dies.

FIG. 30 is a partial cut-away plan view of an embossment of the upper surface 407 of the lower lamina 406. The embossment is analogous to that of FIG. 24 but without the pads 202. The embossment forms a plurality of liquid containment cells 427 defined by walls 423 and baffles 425, similar to walls 205 and baffles 213 described earlier herein with reference to FIG. 24. FIG. 31 shows a preferred arrangement of pins 420 relative to the embossment of FIG. 30. The pins 420 may be arranged on the die 402 is any convenient pattern, such as a matrix pattern wherein the rows and columns are space apart by approximately one centimeter. In the preferred arrangement of FIG. 31 the pins 420 are arranged to be in register with walls 423 and baffles 425 of the embossed pattern. That arrangement of pins causes the high pressure points, and hence the deformations in the lower lamina 406, to coincide with walls 423 and baffles 425. FIG. 32 shows a preferred positional layout of openings 412 in the upper lamina 408 relative to the embossment of FIG. 30. In this particular arrangement, the openings 412 are in register with cells 427 defined by walls 423 and baffles 425 of the embossment of FIG. 30.

It will be understood that the above described arrangements are merely illustrative of the application of the principles of the invention and that various other arrangements may be devised by those skilled in the art without departing from the spirit and scope of the invention.

What we claim is:

1. A tray for liquid-exuding foods, comprising a laminate having an upper lamina and a lower lamina, each of the upper and lower laminae having opposite upper and lower surfaces, the upper lamina having a plurality of openings intersecting the upper and lower surfaces thereof and the lower lamina having a plurality of cavities formed in the upper surface thereof by a plurality of longitudinally extending walls defining a plurality of longitudinally extending channels in the lower lamina, the upper surface of the lower lamina comprising a plurality of baffles extending between adjacent walls to define liquid containment cells on the lower lamina, the longitudinally extending walls comprising a plurality of interconnected wall sections extending at predetermined angles to each other, the exterior angles of walled sections of adjacent ones of the walls being disposed opposite each other.

2. The tray in accordance with claim 1, wherein the interior angles of wall sections of adjacent walls are opposite each other and wherein the upper surface of the lower lamina further comprises raised pads disposed in the areas between opposite interior angles.

3. The tray in accordance with claim 2, wherein the walls have a predetermined height and wherein the pads have a height substantially equal to the predetermined height.

4. The tray in accordance with claim 1, wherein the baffles extend between adjacent ones of the exterior angles of adjacent walls.

5. The tray in accordance with claim 2, wherein each of the cells comprises at least one of the pads.

6. The tray in accordance with claim 2, wherein the upper lamina and the lower lamina are joined at the pads and the walls.

* * * * *

UNITED STATES PATENT AND TRADEMARK OFFICE
CERTIFICATE OF CORRECTION

PATENT NO.: 5,655,708

DATED: August 12, 1997

INVENTOR: HORST-DITMAR GRÖNE

It is certified that error appears in the above-identified patent and that said Letters Patent are hereby corrected as shown below:

Claim 1, col. 12, line 44, "walled" should read --wall--

Signed and Sealed this

Twentieth Day of February, 2001

*Attest:*

Nicholas P. Godici

NICHOLAS P. GODICI

*Attesting Officer*

*Acting Director of the United States Patent and Trademark Office*